US010219065B2

(12) United States Patent
Kaufmann

(10) Patent No.: US 10,219,065 B2
(45) Date of Patent: Feb. 26, 2019

(54) TELECOIL ADAPTER

(71) Applicant: Otojoy LLC, Santa Barbara, CA (US)

(72) Inventor: Thomas Kaufmann, Northrhine-Westphalia (DE)

(73) Assignee: Otojoy LLC, Santa Barbara, CA (US)

( * ) Notice: Subject to any disclaimer, the term of this patent is extended or adjusted under 35 U.S.C. 154(b) by 0 days.

(21) Appl. No.: 15/397,637

(22) Filed: Jan. 3, 2017

(65) Prior Publication Data

US 2017/0118550 A1 Apr. 27, 2017

Related U.S. Application Data

(63) Continuation of application No. 14/622,759, filed on Feb. 13, 2015, now abandoned.

(60) Provisional application No. 62/109,564, filed on Jan. 29, 2015.

(51) Int. Cl.

| | |
|---|---|
| ***H04R 1/10*** | (2006.01) |
| ***H04R 25/00*** | (2006.01) |
| *H04R 5/02* | (2006.01) |

(52) U.S. Cl.

CPC ..... *H04R 1/1041* (2013.01); *H04R 1/1075* (2013.01); *H04R 1/1091* (2013.01); *H04R 25/554* (2013.01); *H04R 1/1016* (2013.01); *H04R 25/556* (2013.01); *H04R 2430/01* (2013.01); *H04R 2460/01* (2013.01)

(58) Field of Classification Search

CPC .. H04R 1/1041; H04R 1/1075; H04R 1/1091; H04R 2430/01; H04R 2460/01

USPC ..... 381/74, 331, 315, 312; 455/569.1

See application file for complete search history.

(56) References Cited

U.S. PATENT DOCUMENTS

| | | | | |
|---|---|---|---|---|
| 7,206,426 | B1 * | 4/2007 | Julstrom | H04R 25/558 381/315 |
| 2014/0163983 | A1 * | 6/2014 | Kim | G10L 15/26 704/235 |
| 2015/0078575 | A1 * | 3/2015 | Selig | H04R 1/1091 381/74 |
| 2015/0141088 | A1 * | 5/2015 | Hosoi | H04M 1/035 455/575.1 |
| 2015/0341724 | A1 * | 11/2015 | Pedersen | H04R 25/552 381/300 |
| 2016/0021229 | A1 * | 1/2016 | Lewis | H04M 1/6033 455/420 |

FOREIGN PATENT DOCUMENTS

DE 202012012100.6 U1 3/2013

OTHER PUBLICATIONS

Application as Filed, U.S. Appl. No. 14/622,759, filed Feb. 13, 2015, 72 Pages.

Filing Receipt & Notice to File Corrected App. Papers, U.S. Appl. No. 14/622,759, Mailed Feb. 27, 2015, 5 Pages.

Response to Notice to File Corrected App. Papers as Filed, U.S. Appl. No. 14/622,759, filed Apr. 27, 2015, 5 Pages.

Updated Filing Receipt, U.S. Appl. No, 14/622,759, Mailed Apr. 30, 2015, 3 Pages.

(Continued)

*Primary Examiner* — Xu Mei
*Assistant Examiner* — Ammar T Hamid
(74) *Attorney, Agent, or Firm* — Berkeley Law & Technology Group, LLP

(57) ABSTRACT

Methods and/or systems are provided for a telecoil adapter.

10 Claims, 6 Drawing Sheets

(56) References Cited

OTHER PUBLICATIONS

Request for Corrected Filing Receipt as Filed, U.S. Appl. No. 14/622,759, filed Jul. 23, 2015, 10 Pages.
Corrected Filing Receipt, U.S. Appl. No. 14/622,759, Mailed Jul. 31, 2015, 3 Pages.
Publication Notice, U.S. App. No. 14/622,759, Received Aug. 12, 2016, 1 Page.
Office Action, U.S. Appl. No. 14/622,759, dated Aug. 10, 2016, 16 Pages.
Response to Office Action as Filed, U.S. Appl. No. 14/622,759, filed Dec. 12, 2016, 13 Pages.

* cited by examiner

TELECOIL ADAPTER

BACKGROUND

1. Field

This disclosure relates to a telecoil adapter

2. Information

A hearing loop system in general refers to a system that transmits sound via an electromagnetic field. Typically, it includes a wire (e.g., in the shape of a loop) connected to an amplifier, connected to a sound system. Thus, via the loop shaped wire, in this example, the system transmits sound electromagnetically to be picked up by a telecoil (also referred to as a t-coil), such as may be included in a hearing aid device, for example. In a hearing loop system, as another example, a public address system may generate an audio signal electronically and may amplify it via an amplifier before being transmitted via a loop wire. The term audio signal in this context refers to a signal carrying an audible sound signal (e.g., having an audible sound signal impressed upon it), although the signal being communicated (e.g., transmitted and/or received) may comprise another form, such as an electrical signal or an electromagnetic signal, for example.

Thus, venues with a hearing loop system, for example, may rent out or sell a hearing loop receiver, where the hearing loop receiver also includes headphones or earphones. The hearing loop receiver may comprise a small electrically conductive coil (e.g., copper or other metal) referred to as a telecoil or t-coil. Thus, a hearing loop system may generate an electromagnetic field capable of inducing an electrical signal in a telecoil of a hearing loop receiver. For example, the induced electrical signal at the hearing loop receiver may be amplified and result in audible sound capable of being heard via the headphones, in this example.

BRIEF DESCRIPTION OF DRAWINGS

Claimed subject matter is particularly pointed out and distinctly claimed in the concluding portion of the specification. However, both to an organization and/or method of operation, together with objects, features, and/or advantages thereof, it may be best understood by reference to the following detailed description if read with the accompanying drawings in which:

Figure 1:
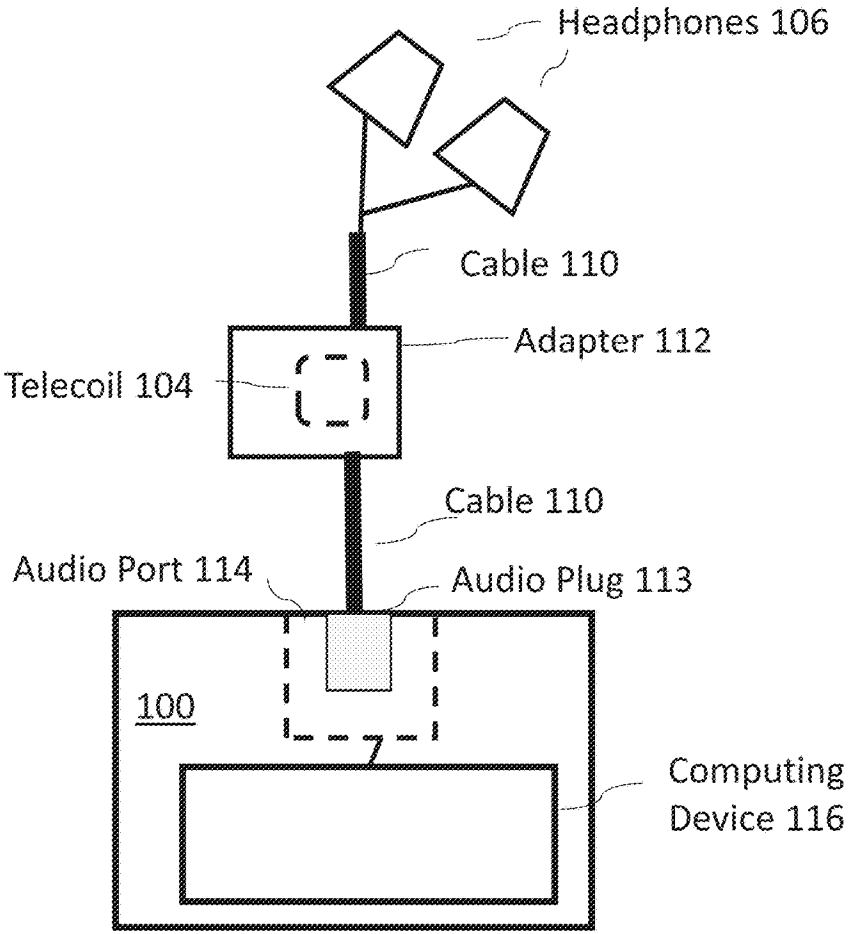
FIG. 1 is a schematic diagram illustrating an embodiment of an apparatus that includes an embodiment of a telecoil adapter.

Reference is made in the following detailed description to accompanying drawings, which form a part hereof, wherein the numerals may designate like parts throughout to indicate corresponding and/or analogous components. It will be appreciated that components illustrated in the figures have not necessarily been drawn to scale, such as for simplicity or clarity of illustration. For example, dimensions of some components may be exaggerated relative to other components. Further, it is understood that other embodiments may be utilized. Furthermore, structural and/or other changes may be made without departing from claimed subject matter. It should also be noted that directions and/or references, for example, up, down, top, bottom, and so on may be utilized to facilitate discussion of drawings and/or are not intended to restrict application of claimed subject matter. Therefore, the following description is not to be taken to limit claimed subject matter and/or equivalents.

DETAILED DESCRIPTION

In the following detailed description, numerous specific details are set forth to provide a thorough understanding of claimed subject matter. For purposes of explanation, specific numbers, systems and/or configurations are set forth, for example. However, it should be apparent to one skilled in the relevant art having benefit of this disclosure that claimed subject matter may be practiced without specific details. In other instances, well-known features may be omitted and/or simplified so as not to obscure claimed subject matter. While certain features have been illustrated and/or described herein, many modifications, substitutions, changes and/or equivalents may occur to those skilled in the art. It is, therefore, to be understood that appended claims are intended to cover any and all modifications and/or changes as fall within claimed subject matter.

References throughout this specification to one implementation, an implementation, one embodiment, an embodiment and/or the like means that a particular feature, structure, and/or characteristic described in connection with a particular implementation and/or embodiment is included in at least one implementation and/or embodiment of claimed subject matter. Thus, appearances of such phrases, for example, in various places throughout this specification are not necessarily intended to refer to the same implementation or to any one particular implementation described. Furthermore, it is to be understood that particular features, structures, and/or characteristics described are capable of being combined in various ways in one or more implementations and, therefore, are within intended claim scope, for example. In general, of course, these and other issues vary with context. Therefore, particular context of description and/or usage provides helpful guidance regarding inferences to be drawn.

With advances in technology, it has become more typical to employ distributed computing approaches in which portions of a problem, such as signal processing of signal samples, for example, may be allocated among computing devices, including one or more clients and/or one or more servers, via a computing and/or communications network, for example. A network may comprise two or more network devices and/or may couple network devices so that signal communications, such as in the form of signal packets and/or frames (e.g., comprising one or more signal samples), for example, may be exchanged, such as between a server and a client device and/or other types of devices, including between wireless devices coupled via a wireless network, for example.

A network may comprise two or more network devices and/or may couple network devices so that signal communications, such as in the form of signal packets, for example, may be exchanged, such as between a server and a client device and/or other types of devices, including between wireless devices coupled via a wireless network, for example.

In this context, the term network device refers to any device capable of communicating via and/or as part of a network and may comprise a computing device. While network devices may be capable of sending and/or receiving signals (e.g., signal packets and/or frames), such as via a wired and/or wireless network, they may also be capable of performing arithmetic and/or logic operations, processing and/or storing signals (e.g., signal samples), such as in memory as physical memory states, and/or may, for example, operate as a server in various embodiments. Network devices capable of operating as a server, or otherwise, may include, as examples, dedicated rack-mounted servers, desktop computers, laptop computers, set top boxes, tablets, netbooks, smart phones, wearable devices, integrated devices combining two or more features of the foregoing devices, the like or any combination thereof. As mentioned, signal packets and/or frames, for example, may be exchanged, such as between a server and a client device and/or other types of network devices, including between wireless devices coupled via a wireless network, for example. It is noted that the terms, server, server device, server computing device, server computing platform and/or similar terms are used interchangeably. Similarly, the terms client, client device, client computing device, client computing platform and/or similar terms are also used interchangeably. While in some instances, for ease of description, these terms may be used in the singular, such as by referring to a "client device" or a "server device," the description is intended to encompass one or more client devices and/or one or more server devices, as appropriate. Along similar lines, references to a "database" are understood to mean, one or more databases and/or portions thereof, as appropriate.

It should be understood that for ease of description, a network device (also referred to as a networking device) may be embodied and/or described in terms of a computing device. However, it should further be understood that this description should in no way be construed that claimed subject matter is limited to one embodiment, such as a computing device and/or a network device, and, instead, may be embodied as a variety of devices or combinations thereof, including, for example, one or more illustrative examples.

Operations and/or processing, such as in association with networks, such as computing and/or communications networks, for example, may involve physical manipulations of physical quantities. Typically, although not necessarily, these quantities may take the form of electrical and/or magnetic signals capable of, for example, being stored, transferred, combined, processed, compared and/or otherwise manipulated. It has proven convenient, at times, principally for reasons of common usage, to refer to these signals as bits, data, values, elements, symbols, characters, terms, numbers, numerals and/or the like. It should be understood, however, that all of these and/or similar terms are to be associated with appropriate physical quantities and are intended to merely be convenient labels.

Likewise, in this context, the terms "coupled", "connected," and/or similar terms are used generically. It should be understood that these terms are not intended as synonyms. Rather, "connected" is used generically to indicate that two or more components, for example, are in direct physical, including electrical, contact; while, "coupled" is used generically to mean that two or more components are potentially in direct physical, including electrical, contact; however, "coupled" is also used generically to also mean that two or more components are not necessarily in direct contact, but nonetheless are able to co-operate and/or interact. The term coupled is also understood generically to mean indirectly connected, for example, in an appropriate context.

The terms, "and", "or", "and/or" and/or similar terms, as used herein, include a variety of meanings that also are expected to depend at least in part upon the particular context in which such terms are used. Typically, "or" if used to associate a list, such as A, B or C, is intended to mean A, B, and C, here used in the inclusive sense, as well as A, B or C, here used in the exclusive sense. In addition, the term "one or more" and/or similar terms is used to describe any feature, structure, and/or characteristic in the singular and/or is also used to describe a plurality and/or some other combination of features, structures and/or characteristics. Likewise, the term "based on" and/or similar terms are understood as not necessarily intending to convey an exclusive set of factors, but to allow for existence of additional factors not necessarily expressly described. Of course, for all of the foregoing, particular context of description and/or usage provides helpful guidance regarding inferences to be drawn. It should be noted that the following description merely provides one or more illustrative examples and claimed subject matter is not limited to these one or more illustrative examples; however, again, particular context of description and/or usage provides helpful guidance regarding inferences to be drawn.

A network may also include now known, and/or to be later developed arrangements, derivatives, and/or improvements, including, for example, past, present and/or future mass storage, such as network attached storage (NAS), a storage area network (SAN), and/or other forms of computing and/or device readable media, for example. A network may include a portion of the Internet, one or more local area networks (LANs), one or more wide area networks (WANs), wire-line type connections, wireless type connections, other connections, or any combination thereof. Thus, a network may be worldwide in scope and/or extent. Likewise, sub-networks, such as may employ differing architectures and/or may be substantially compliant and/or substantially compatible with differing protocols, such as computing and/or communication protocols (e.g., network protocols), may interoperate within a larger network. In this context, the term sub-network and/or similar terms, if used, for example, with respect to a network, refers to the network and/or a part thereof. Sub-networks may also comprise links, such as physical links, connecting and/or coupling nodes, such as to be capable to transmit signal packets and/or frames between devices of particular nodes, including wired links, wireless links, or combinations thereof. Various types of devices, such as network devices and/or computing devices, may be made available so that device interoperability is enabled and/or, in at least some instances, may be transparent to the devices. In this context, the term transparent refers to devices, such as network devices and/or computing devices, communicating via a network in which the devices are able to communicate via intermediate devices of a node, but without the communicating devices necessarily specifying one or more intermediate devices of one or more nodes and/or may include communicating as if intermediate devices of intermediate nodes are not necessarily involved in communication transmissions. For example, a router may provide a link and/or connection between otherwise separate and/or independent LANs. In this context, a private network refers to a particular, limited set of network devices able to communicate with other network devices in the particular, limited set, such as via signal packet and/or frame transmissions, for example, without a need for re-routing and/or redirecting transmissions. A private network may comprise a stand-alone network; however, a private network may also comprise a subset of a larger network, such as, for example, without limitation, all or a portion of the Internet. Thus, for example, a private network "in the cloud" may refer to a private network that comprises a subset of the Internet, for example. Although signal packet and/or frame transmissions may employ intermediate devices of intermediate nodes to exchange signal packet and/or frame transmissions, those intermediate devices may not necessarily be included in the private network by not being a source or destination for one or more signal packet and/or frame transmissions, for example. It is understood in this context that a private network may provide outgoing network communications to devices not in the private network, but devices outside the private network may not necessarily be able to direct inbound network communications to devices included in the private network.

The Internet refers to a decentralized global network of interoperable networks that comply with the Internet Protocol (IP). It is noted that there are several versions of the Internet Protocol. Here, the term Internet Protocol, IP, and/or similar terms, is intended to refer to any version, now known and/or later developed of the Internet Protocol. The Internet includes local area networks (LANs), wide area networks (WANs), wireless networks, and/or long haul public networks that, for example, may allow signal packets and/or frames to be communicated between LANs. The term World Wide Web (WWW or Web) and/or similar terms may also be used, although it refers to a part of the Internet that complies with the Hypertext Transfer Protocol (HTTP). For example, network devices may engage in an HTTP session through an exchange of appropriately substantially compatible and/or substantially compliant signal packets and/or frames. It is noted that there are several versions of the Hypertext Transfer Protocol. Here, the term Hypertext Transfer Protocol, HTTP, and/or similar terms is intended to refer to any version, now known and/or later developed. It is likewise noted that in various places in this document substitution of the term Internet with the term World Wide Web ('Web') may be made without a significant departure in meaning and may, therefore, not be inappropriate in that the statement would remain correct with such a substitution.

Although claimed subject matter is not in particular limited in scope to the Internet and/or to the Web; nonetheless, the Internet and/or the Web may without limitation provide a useful example of an embodiment at least for purposes of illustration. As indicated, the Internet and/or the Web may comprise a worldwide system of interoperable networks, including interoperable devices within those networks. The Internet and/or Web has evolved to a public, self-sustaining facility that may be accessible to tens of millions of people or more worldwide. Also, in an embodiment, and as mentioned above, the terms "WWW" and/or "Web" refer to a part of the Internet that complies with the Hypertext Transfer Protocol. The Internet and/or the Web, therefore, in this context, may comprise an service that organizes stored content, such as, for example, text, images, video, etc., through the use of hypermedia, for example. A HyperText Markup Language ("HTML"), for example, may be utilized to specify content and/or to specify a format for hypermedia type content, such as in the form of a file and/or an "electronic document," such as a Web page, for example. An Extensible Markup Language ("XML") may also be utilized to specify content and/or format of hypermedia type content, such as in the form of a file or an "electronic document," such as a Web page, in an embodiment. Of course, HTML and/or XML are merely example languages provided as illustrations. Furthermore, HTML and/or XML (and/or similar terms) is intended to refer to any version, now known and/or later developed of these languages. Likewise, claimed subject matter is not intended to be limited to examples provided as illustrations, of course.

As used herein, the term "Web site" and/or similar terms refer to a collection of related Web pages. Also as used herein, "Web page" and/or similar terms refer to any electronic file and/or electronic document, such as may be accessible via a network, including by specifying a URL for accessibility via the Web, in an example embodiment. As alluded to above, in one or more embodiments, a Web page may comprise content coded using one or more languages, such as, for example, markup languages, including HTML and/or XML, although claimed subject matter is not limited in scope in this respect. Also, in one or more embodiments, application developers may write code in the form of JavaScript, for example, to provide content to populate one or more templates, such as for an application. The term 'JavaScript' and/or similar terms are intended to refer to any now known and/or later developed version of this programming language. However, JavaScript is merely an example programming language. As was mentioned, claimed subject matter is not intended to be limited to examples and/or illustrations.

As used herein, the terms "entry", "electronic entry", "document", "electronic document", "content", "digital content", "item", and/or similar terms are meant to refer to signals and/or states in a physical format, such as a digital signal and/or digital state format, e.g., that may be perceived by a user if displayed, played and/or otherwise executed by a device, such as a digital device, including, for example, a computing device, but otherwise might not necessarily be perceivable by humans (e.g., in a digital format). Likewise, in this context, content (e.g., digital content) provided to a user in a form so that the user is able to perceive the underlying content itself (e.g., hear audio or see images, as examples) is referred to, with respect to the user, as 'consuming' content, 'consumption' of content, 'consumable' content and/or similar terms. For one or more embodiments, an electronic document may comprise a Web page coded in a markup language, such as, for example, HTML (hypertext markup language). In another embodiment, an electronic document may comprise a portion or a region of a Web page. However, claimed subject matter is not intended to be limited in these respects. Also, for one or more embodiments, an electronic document and/or electronic entry may comprise a number of components. Components in one or more embodiments may comprise text, for example, in the form of physical signals and/or physical states (e.g., capable of being physically displayed). Also, for one or more embodiments, components may comprise a graphical object, such as, for example, an image, such as a digital image, and/or sub-objects, such as attributes thereof, which, again, comprise physical signals and/or physical states (e.g., capable of being physically displayed). In an embodiment, content may comprise, for example, text, images, audio, video, and/or other types of electronic documents and/or portions thereof, for example.

Also as used herein, one or more parameters may be descriptive of a collection of signal samples, such as one or more electronic documents, and exist in the form of physical signals and/or physical states, such as memory states. For example, one or more parameters, such as referring to an electronic document comprising an image, may include parameters, such as time of day at which an image was captured, latitude and longitude of an image capture device, such as a camera, for example, etc. In another example, one or more parameters relevant to content, such as content comprising a technical article, may include one or more authors, for example. Claimed subject matter is intended to embrace meaningful, descriptive parameters in any format, so long as the one or more parameters comprise physical signals and/or states, which may include, as parameter examples, name of the collection of signals and/or states (e.g., file identifier name), technique of creation of an electronic document, purpose of an electronic document, time and date of creation of an electronic document, logical path of an electronic document (or portion thereof), encoding formats and/or standards used for encoding an electronic document, and so forth.

Signal packets and/or frames, also referred to as signal packet transmissions and/or signal frame transmissions, may be communicated between nodes of a network, where a node may comprise one or more network devices and/or one or more computing devices, for example. As an illustrative example, but without limitation, a node may comprise one or more sites employing a local network address. Likewise, a device, such as a network device and/or a computing device, may be associated with that node. A signal packet and/or frame may, for example, be communicated via a communication channel and/or a communication path, such as comprising a portion of the Internet and/or the Web, from a site via an access node coupled to the Internet. Likewise, a signal packet and/or frame may be forwarded via network nodes to a target site coupled to a local network, for example. A signal packet and/or frame communicated via the Internet and/or the Web, for example, may be routed via a path comprising one or more gateways, servers, etc. that may, for example, route a signal packet and/or frame substantially in accordance with a target and/or destination address and availability of a network path of network nodes to the target and/or destination address. Although the Internet and/or the Web comprise a network of interoperable networks, not all of those interoperable networks are necessarily available and/or accessible to the public.

In particular implementations, a network protocol for communicating between devices may be characterized, at least in part, substantially in accordance with a layered description, such as the so-called Open Systems Interconnection (OSI) seven layer approach and/or description. A network protocol refers to a set of signaling conventions, such as for computing and/or communications transmissions, for example, as may take place between and/or among devices in a network, typically network devices; for example, devices that substantially comply with the protocol and/or that are substantially compatible with the protocol. In this context, the term "between" and/or similar terms are understood to include "among" if appropriate for the particular usage and vice-versa. Likewise, in this context, the terms "compatible with", "comply with" and/or similar terms are understood to include substantial compliance and/or substantial compatibility.

Typically, a network protocol, such as protocols characterized substantially in accordance with the aforementioned OSI description, has several layers. These layers may be referred to here as a network stack. Various types of transmissions, such as network transmissions, may occur across various layers. A lowest level layer in a network stack, such as the so-called physical layer, may characterize how symbols (e.g., bits and/or bytes) are transmitted as one or more signals (and/or signal samples) over a physical medium (e.g., twisted pair copper wire, coaxial cable, fiber optic cable, wireless air interface, combinations thereof, etc.). Progressing to higher-level layers in a network protocol stack, additional operations may be available by initiating network transmissions that are substantially compatible and/or substantially compliant with a particular network protocol at these higher-level layers. For example, higher-level layers of a network protocol may, for example, affect device permissions, user permissions, etc.

A virtual private network (VPN) may enable a remote device to more securely (e.g., more privately) communicate via a local network. A router may allow network communications in the form of network transmissions (e.g., signal packets and/or frames), for example, to occur from a remote device to a VPN server on a local network. A remote device may be authenticated and a VPN server, for example, may create a special route between a local network and the remote device through an intervening router. However, a route may be generated and/or also regenerated if the remote device is power cycled, for example. Also, a VPN typically affects a single remote device.

A hearing loop system in general refers to a system that transmits sound via an electromagnetic field. Typically, it includes a wire (e.g., in the shape of a loop) connected to a sound system. Thus, via the loop shaped wire, in this example, the system may transmit sound electromagnetically to be picked up by a telecoil (also referred to as a t-coil), such as may be included in a hearing aid device, for example. That is, the term telecoil or t-coil in general refers to a device intended to operate in conjunction with a hearing loop system, as just described, in order to receive audio signals as wireless electromagnetic signals. In a hearing loop system, as another example, a public address system may generate audio signals electronically and may amplify the signals via an amplifier before being transmitted via a loop wire. The term audio signals in this context refers to signals carrying audible sound signals (e.g., having audible sound signals impressed thereof), although the signals being communicated (e.g., transmitted and/or received) may comprise another form, such as electrical signals or an electromagnetic signals, for example.

Thus, venues with a hearing loop system, for example, may rent out or sell a hearing loop receiver, where the hearing loop receiver also includes headphones. The hearing loop receiver may comprise a small electrically conductive coil (e.g., copper or other metal) referred to as a telecoil or t-coil. Thus, a hearing loop system may generate an electromagnetic field capable of inducing electrical signals in a telecoil of a hearing loop receiver. For example, induced electrical signals at the hearing loop receiver may be amplified and result in audible sounds capable of being heard via the headphones, in this example.

It is likewise understood that signals, such as electrical signals, may go through an innumerable number of signal transformations before being received at an emitter to produce stimuli, such as auditory stimuli. Examples of auditory emitters may comprise speakers, headphones, ear buds, etc. If something is referred to as auditory signals, although present in a different physical form, such as electrical signals, it is understood to refer to a physical phenomenon or physical phenomena that the signals represent. Thus, for example, auditory signals (e.g., audio signals) may refer to electrical signals transmitted, such as via an electrical wire or wirelessly, to an emitter, such as a speaker, so that underlying audio signals are capable of being heard. In this example, the emitter may produce auditory output signals in response to received electrical signals. For example, electrical signals may be transformed from analog to digital or vide-versa. Likewise, signals may be compressed, encoded, packetized, encrypted, etc. and still remain auditory signals in this context. The term waveform refers to a particular type of signal or signals, e.g., having a particular form and shape including, for example, signals having a form of a wave.

Individuals (e.g., users) may be affected with conditions that impair an ability to hear and, thus, may use a hearing aid for amplification and/or to perform other signal conditioning to improve sound perception. It is noted that throughout this document users and individuals are referred to interchangeably. Hearing loop systems are a form of assistive listening systems and may assist individuals with, for example, hearing loss, difficult with speech intelligibility, and/or clarity of sound, such as in the presence of external noises (e.g., ambient noise, echo, and/or reverberation). Further, hearing loop systems may also assist individuals in situations where a sound source, such as a loudspeaker or a person speaking, may be distant, especially for individuals with hearing aids and/or cochlear implants. For example, a microphone may be placed at ear level and may pick up additional surrounding sounds beyond sounds desired and/or intended to be picked up, such as speech or musical components, for example.

In an embodiment, a hearing loop system may transfer sound wirelessly, as previously suggested. As was also mentioned, a hearing loop system may generate an electromagnetic field capable of inducing electrical signals in a physically non-attached, and in some instances, reasonably distant, component, such as a telecoil. Hearing loop systems may be installed at public venues, for example, theaters, auditoriums, places of worship, public meeting rooms, conference rooms, and/or public transportation facilities. Hearing loop systems may also be located in venues with transient populations including, as examples, ticket counters, information desks, and/or drive-through windows.

In an illustrative embodiment, as mentioned, a hearing loop system may comprise a public address system and a hearing loop amplifier, for example. The system may also include a loop wire to surround all or part of a venue. The loop wire may be embedded and/or installed as part of a floor, ceiling, and/or wall, for example. In an illustrative embodiment, for example, the loop wire may be installed with a protective shielding for burial in concrete or with a flat tape for installation under carpets or other floor coverings. In operation, the loop wire may function as an antenna. Thus, as a result of current flow in the hearing loop wire, for example, an electromagnetic field may be modulated substantially in accordance with audio signals, for example.

Before a hearing loop system is installed at a facility, a level of electromagnetic background noise may be evaluated. For example, an International Electrotechnical Commission (IEC) standard, 60018-4:2006, available from the IEC located in Geneva Switzerland, sets a standard for a hearing loop system to provide a signal-to-noise ratio (SNR) of at least 32 dB, and preferably an SNR of 47 dB. For example, a field strength meter may be able to measure a level of electromagnetic background noise. Electromagnetic field strength, homogeneity, and/or frequency response, for a venue, for example, may also be measured and may be considered in connection with designing and/or implementing a hearing loop system.

As suggested previously, a telecoil may comprise a small inductor. Thus, if a sound source provides sound of an appropriate quality, likewise, a hearing loop receiver may provide relatively high quality sound. Speech, for example, may be more intelligible, as a result. In an implementation and/or embodiment, a hearing loop receiver comprising a t-coil, electrical signals, such as current signals, for example, may be induced from a modulating electromagnetic (EM) field emanating from or generated by a current flowing through a loop wire, as previously described. The hearing loop receiver in this example may likewise comprise a power source, an amplifier, a headphone jack, headphones to plug into the headphone jack, and a lanyard. A lanyard, for example, may allow placement around a user's neck. As previously explained, induced signals may comprise audio signals, which may therefore in this embodiment be provided, such as via an electrically conductive wire, to the headphones from the headphone jack. In some situations, individuals may use headphones provided or use their own.

However, in some cases, individuals may not feel comfortable using provided headphones for a variety of reasons. Some examples of reasons may include: privacy (or independence) concerns (e.g., have to leave an ID, or deposit via credit card); lack of comfort with identifying themselves as hearing impaired; provided headphones (and also perhaps the hearing loop receiver) may be bulky and/or less than desirable quality; and/or for hygienic issues (e.g., other people may have used the headphones).

Consumer electronic devices, including, as example, digital media players, smart phones, tablets, etc. are prevalent. Thus, in an implementation and/or embodiment, a smart phone, for example, may be employed as a media player. Thus, a smart phone, for example, typically includes an audio jack and is capable of generating audio signals. In this context, the term audio jack refers to a receptacle to physically receive a standard audio plug so that electrical signals may be passed from the plug to the jack or from the jack to the plug. In this context, the term standard audio plug refers to a 3.5 mm or a 2.5 mm audio plug both of which are in prevalent use. Likewise, an audio jack may be referred to as audio plug compatible in this context.

However, if a smart phone, for example, were to be employed with a telecoil, proximity of the telecoil to the smart phone may produce electrical interference, such as with other radio frequency (RF) signals that may be generated or received by the smart phone, for example. This may potentially result in noise and/or distortion that may be unwanted. Thus, placing a telecoil within or in relatively close proximity, such as immediately adjacent, for example, to a smart phone without an appropriate amount of shielding to reduce potential electrical interference, may not be practical.

FIG. 1 illustrates a schematic diagram of an embodiment 112 of a telecoil adapter for use with a variety of devices, such as a smart phone, a tablet, etc. In this context, the term telecoil adapter refers to a complete or partial enclosure housing a telecoil in a manner so that the telecoil may be included in an electrical circuit. A variety of embodiments are possible, however, as described below. Likewise, the term smart phone refers to a device that includes cell phone functionality along with a computing device that may be employed to provide additional functionality.

In an embodiment, as illustrated in FIG. 1, for example, an apparatus may include adapter 112, with a telecoil 104, headphones 106, and a standard audio plug 113, the foregoing electrically connected via a cable 110. Telecoil 104 in an embodiment may be integrated in the adapter 112, but this is not required. As shown in FIG. 1, an embodiment 100 of a mobile device in this example, such as a smart phone or tablet, includes a computing device 116. Likewise, mobile device embodiment 100 also includes a port 114 that is audio plug compatible, also referred to here as an audio jack. While cable 110 is shown as connecting headphones 106 to telecoil 104, alternatively, adapter 112 may also include a standard audio jack so that headphones having a standard audio plug may be used to connect to telecoil 104 via the jack of the telecoil adapter in such a case.

In embodiments, headphones, such as 106, and a telecoil, such as 104, may be implemented in any one of a variety of ways intended to be covered by claimed subject matter. For example, headphones 106 may comprise ear buds. Alternately, in other embodiments, headphones 106 may comprise earphones. In embodiments, telecoil 104 may comprise an active telecoil. Alternately, in other embodiments, telecoil 104 may comprise a passive telecoil, such as, for example, an inductor. Likewise, a variety of additional electrical components may likewise be included in an adapter. An operational amplifier may potentially, for example, in addition to providing signal amplification, provide electrical isolation. In addition, as another example, and as discussed in more detail below, capacitors may provide electrical isolation and/or be included as part of a signal filter.

As previously discussed, audio signals may be induced, in the form of electrical signals, and then amplified by adapter 112, for example. As will be appreciated, the mechanism previously described for generating audio signals is analog, resulting in analog audio signals. However, computing device 116, which receives audio signals from telecoil 104 via cable 110, audio plug 113 and audio port 114, may convert analog audio signals into digital audio signals via analog-to-digital conversion. In digital form, a computing device may perform additional digital signal processing. After digital signal processing, a computing device may convert a processed digital audio signals to analog form so that it may be provided to headphones 106 via port 114, plug 113 and cable 110. In this illustrative example, headphones 106 may comprise a speaker, which may receive audio signals as analog electrical signals and may generate sounds audible to a user by vibrating so as to move air relatively near the user's ear(s). Movement of air may therefore generate audible sound waves.

Cable 110 may also be implemented a variety of ways. For example, depending at least in part on construction, cable 110 may be able to support features, such as, for example, stereo audio, microphone signals and/or other signals (e.g., signals from a user input device and/or signals for a status indicator). For similar reasons, audio plug 113 and/or the audio port 114, may also be implemented in a variety of ways and/or support a variety of features, which may include ground, left and right audio, and/or a variety of tip-ring-sleeve configurations. Similarly, construction of adapter housing and/or other parts of an adapter form factor may vary in various ways, such as including electrically conductive material and/or material providing electrical insulation and/or shielding in various ways.

In embodiments, an adapter may include a fastener 122 for fastening to clothing of a user, for example. Again, a variety of implementations are possible including a needle pin, a plastic clip, and/or a magnet. In embodiments, a fastener, such as 122, may be positioned so that telecoil 104 may have a substantially vertical orientation during use. Likewise, a hearing loop system may have been calibrated at a listening plane around ear level for users, for example. Thus, for an embodiment of a telecoil adapter, during use, the telecoil, such as 103, may be oriented substantially vertically and in relative proximity to ear level. In an embodiment, having a telecoil completely or partially enclosed in an adapter, and having the adapter integrated into a cable, connected on one end to headphones and on another end to a computing device, a user may assume a comfortable position during use while maintaining reasonably consistent reception quality. In addition, in this manner, use of shielding to reduce electrical interference may not be necessary even for use with a smart phone, for example, since the telecoil (e.g., within an adapter) would not be immediately adjacent to the smart phone, in this example illustrative embodiment.

Figure 2:
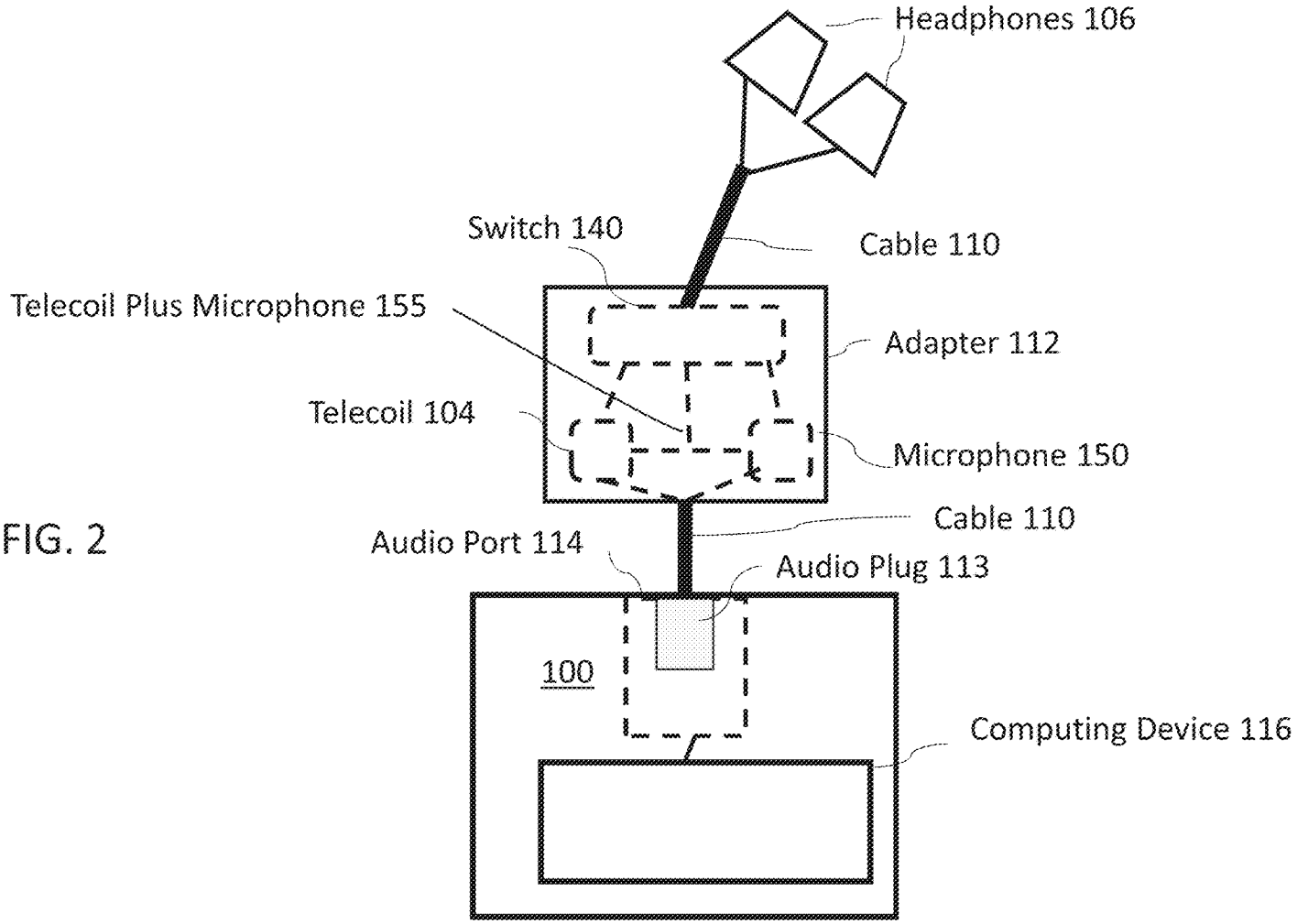
FIG. 2 is a schematic diagram illustrating another embodiment of an apparatus that includes another embodiment of a telecoil adapter.

FIG. 2 illustrates a schematic diagram of an additional embodiment of an telecoil adapter, such as may be employed with a smart phone, for example. In FIG. 2, adapter 112, for example, may comprise a microphone 150 and a switch 140. Of course, microphone 150 may be included in an embodiment of a telecoil adapter in a manner so as to be functional. For example, in this embodiment, switch 140 may toggle between telecoil 104 and microphone 150. Thus, if switch 140 toggles to close a circuit with microphone 150, microphone 150 may be utilized in conjunction with headphones, such as to place and/or receive telephone calls via a smart phone. Thus, rather than carrying a smart phone, a hearing loop receiver, and headphones, a user may carry headphones, which include a telecoil adapter, and a smartphone, which in general should be more convenient.

Further, FIG. 2 illustrates a schematic diagram of an additional embodiment of a telecoil adapter, such as may be employed with a smart phone, for example. In FIG. 2, adapter 112, for example, may comprise a microphone 150 and a three-way switch 140. For example, in this embodiment, switch 140 may toggle between telecoil 104, microphone 150, and a position 155 where both the telecoil and microphone are activated. Thus, if switch 140 toggles to position 155 to close a circuit with both telecoil 104 and microphone 150, telecoil 104 may be utilized to induce audio signals, in the form of electrical signals, while microphone 150 may be utilized to pick up and/or receive signals from the environment surrounding the user. For example, this may improve a user's perception of the environment rather than a user feeling isolated as a result of absence of environmental sounds.

Figure 3:
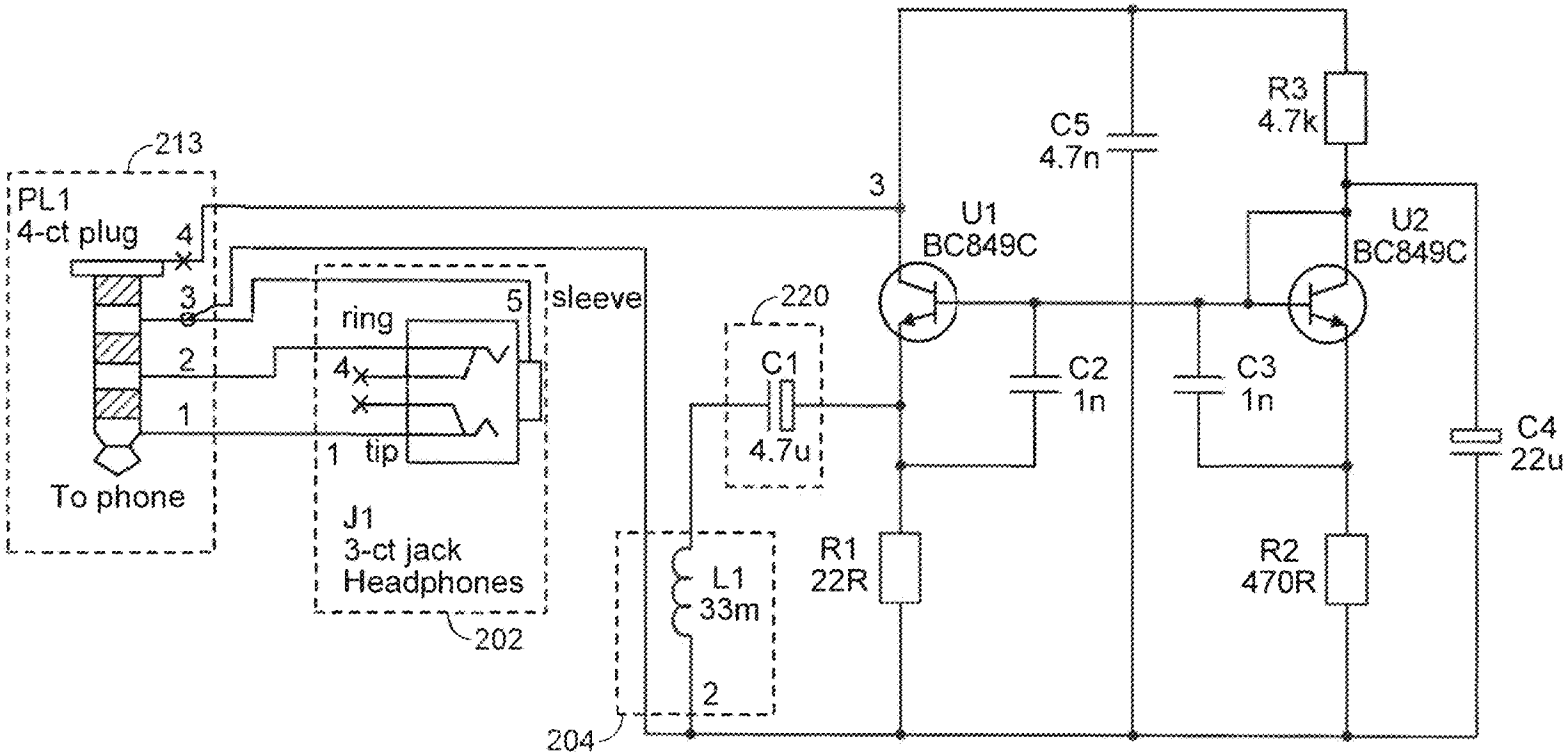
FIG. 3 is a circuit diagram illustrating still another embodiment of an apparatus that includes still another embodiment of a telecoil adapter.

In an embodiment, as alluded to above, additional circuit components may be included in a telecoil adapter embodiment, such as a capacitor to at least partially block DC signal components from being transferred to telecoil 104. Likewise, signal filter components may be included to enhance characteristics of analog electrical audio signals, such as generated via an active telecoil. For example, electromagnetic background noise may be present from a variety of sources, such as electrical wiring (e.g., external to a circuit including a telecoil) and/or fluorescent lights. For example, electromagnetic background noise may be present at frequencies of 50 or 60 Hz and/or may include spurious harmonic components above 50 or 60 Hz. Thus, various approaches to realize a filter via circuit components may be employed in a telecoil adapter embodiment. FIG. 3, for example, is a circuit diagram of an embodiment showing one illustrative example of an arrangement of circuit components for a telecoil included in an adapter, such as may be employed with a smart phone, for example. This illustrative example includes a capacitor 220, a telecoil 204, an audio jack 213 and headphones 202, as shown. Although the circuit diagram of FIG. 3 shows the above-identified components, claimed subject matter is not limited to circuits having only these components as other implementations may include alternative arrangements that may comprise additional components or fewer components, such as components that function differently while achieving similar results. Rather, examples are provided merely as illustrations. Of course, claimed subject matter is not limited in scope to illustrative examples. Nonetheless, continuing, in this example, audio jack 213 may comprise a four pin audio connector. Thus, two lines are connected to telecoil 204 and three lines are connected to headphones 202. In this example, capacitor 220 may reduce spurious signals from reaching telecoil 204. Likewise, additional components, as shown, may provide signal amplification and/or may reduce noise, such as, from signals at frequencies outside a desired frequency range.

Figure 4:
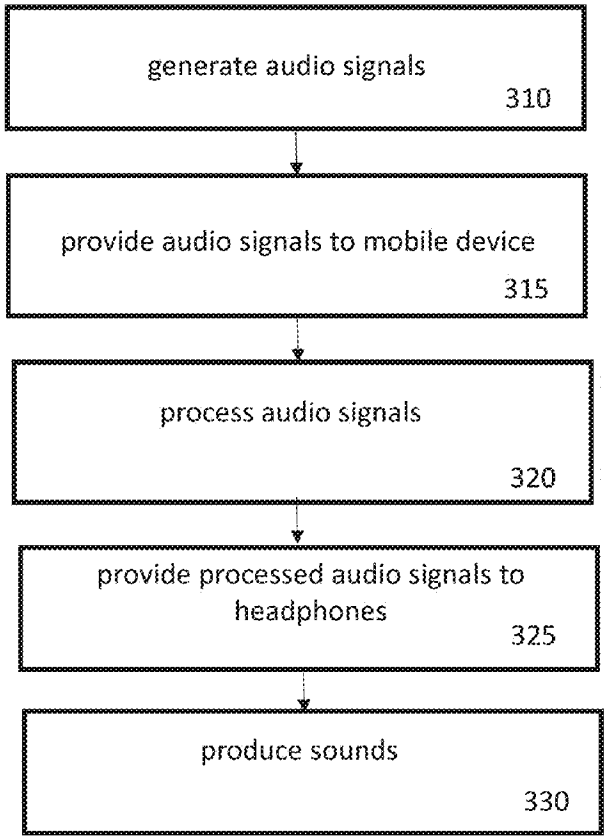
FIGS. 4 and 5 are flow diagrams illustrating an embodiment of a method of using the embodiment of FIG. 2.
Figure 5:
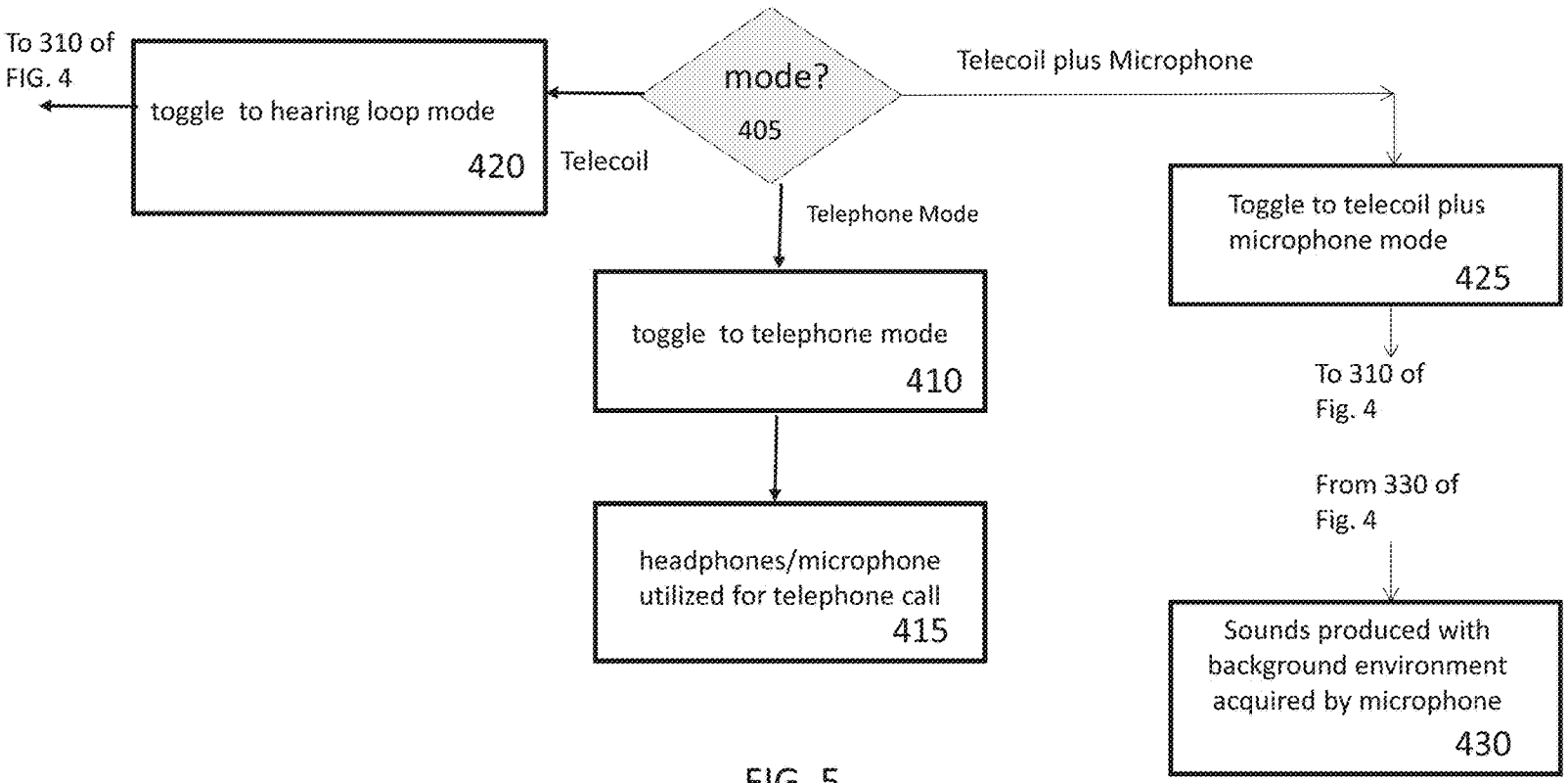

FIGS. 4 and 5 are flow diagrams for an embodiment of a method for use of the embodiment of FIG. 2 with a smart phone. However, again, claimed subject matter is not limited to illustrative examples, such as FIG. 2, 4 or 5, for example. Thus, it is intended that alternate arrangements of components in other implementations be included within claimed subject matter. Likewise, an embodiment of a method may include blocks in addition to those shown and described, fewer blocks, blocks occurring in a different order than may be identified, or combinations thereof. Likewise, for ease of implementation, an embodiment may be simplified to illustrate aspects and/or features in a manner that is intended to not obscure claimed subject matter through excessive specificity and/or unnecessary details.

Referring to FIG. 4, at block 310, a telecoil, such as 104, may generate and amplify audio signals, such as previously described, for example, in the form of analog electrical signals. At block 315, audio signals in the form of analog electrical signals, may be provided to a device, such as a smart phone, that may include a computing device, such as 116, via a cable, such as 110. As previously described, signal processing may take place, such as indicated by block 320, including analog to digital conversion, digital signal filtering and/or digital to analog conversion, At block 325, audio signals, after being processed, may be provided to headphones, such as 106, As a result, as indicated by block 330, sounds may be produced.

Referring to FIG. 5, at block 405, for an embodiment, a decision may be made regarding mode of operation. Thus, referring to FIG. 2, for example, switch 140 may be toggled. A variety of approaches to toggling switch 140 are possible. For example, a user may toggle the switch or a user may select a mode of operation via a device, such as a smart phone, that may provide signals to toggle the switch. Likewise, if a telephone call were received, this may amount to a decision to operate in telephone mode in an embodiment and thereby result in toggling. Alternatively, if a user is operating in hearing loop mode, switching may, in an embodiment, be inhibited, such as if a user is listening to a presentation. Likewise, as another alternative, whether or not a telephone call may interrupt hearing loop mode may comprise a setting to be selected. Furthermore, there are merely illustrative examples. Other approaches are also intended to be included, of course, within claimed subject matter.

Nonetheless, continuing, if telephone mode, for example, is selected as the present mode, at block 410, switch 140 may be toggled to bypass telecoil 104, as illustrated in FIG. 2, for example. Thus, as indicated at block 415, in this mode, a microphone and headphones may be enabled for use with a telephone call. Similarly, if, instead, hearing loop mode is selected, as indicated by block 410, switch 140 may be toggled so that telecoil 104 is connected via cable 110, in this example, to computing device 116. Thus, as indicated in FIG. 5, operation may proceed as indicated by block 310 of FIG. 4. Additionally, if instead a telecoil plus microphone mode is selected, as indicated by block 425, switch 140 may be toggled so that telecoil 104 is connected via cable 110, in this example, to computing device 116, while the microphone and headphones may be enabled for use in acquiring and producing sound from an environment in which the adapter is located. Thus, as is indicated in FIG. 5, operation may proceed as indicated to block 310 of FIG. 4 and then return to block 430 where the sound generated in block 330 is produced along with sound from the surrounding environment.

If an embodiment of a telecoil adapter is being used along with a smart phone, after analog to digital conversion, as previously described, and potentially including additional signal processing, perhaps, resulting digital signals may be stored, such as via a storage medium of a smart phone, for example. Likewise, in an embodiment, a computing device, such as 116, also included as a component of a smart phone, for example, may execute a speech-to-text converter to convert audio signals, stored in a digital format, as previously described, into a text representation. Thus, for example, in an embodiment, a transcript may be generated corresponding to the audio signals. Of course, alternately, speech to text conversion and/or transcript generation may take place before storage and/or without storage. However, likewise, in an embodiment, digital signals corresponding to a generated text representation may likewise be stored via a storage medium of a smart phone, for example. Likewise, in an embodiment, audio signals and/or a text representation, in the form of digital signals, may be transmitted via a computing and/or communications network to another device on the network, such as from a smart phone.

In an illustrative embodiment, in connection with use that may include a smart phone, the smart phone may include a capability to perform noise cancellation on digital audio signals to improve audio signal quality. It should be noted that the following description provides an illustrative example; however, claimed subject matter is not limited to illustrative examples. In an embodiment, a smart phone may capture background electrical signals despite no audio signal being induced in the telecoil. For example, background electrical signals may be acquired in an analog form, may be converted to a digital form, and may be stored in memory. In an embodiment, captured signals, as described, for example, may be subtracted from electrical signals that include audio signals, potentially to improve signal-to-noise ratio.

In another illustrative embodiment, again, in connection with use that may include a smart phone, audio signals may be evaluated for quality. For example, a variety of aspects of audio signals may be evaluated, such as sound quality, pitch, signal-to-noise ratio and/or a variety of other audio characteristics. Likewise, in an embodiment, audio signals to be evaluated may be associated with a hearing loop system. After rating of the audio signals, both the particular system and its associated rating may be stored. Along similar lines, in an embodiment in which speech-to-text conversion takes place, if a reference for comparison is available, likewise, the conversion to text may be evaluated, rated, associated with the particular hearing loop system and similarly stored. In an illustrative embodiment, a reference text file corresponding to the audio signals may be compared to the converted text representation, for example. Other features may also be included in an illustrative embodiment. For example, a smart phone may include a capability to equalize amplitudes of different frequency components of the audio signals and/or may include a capability to digitally filter audio signals to improve signal to noise merit.

Figure 6:
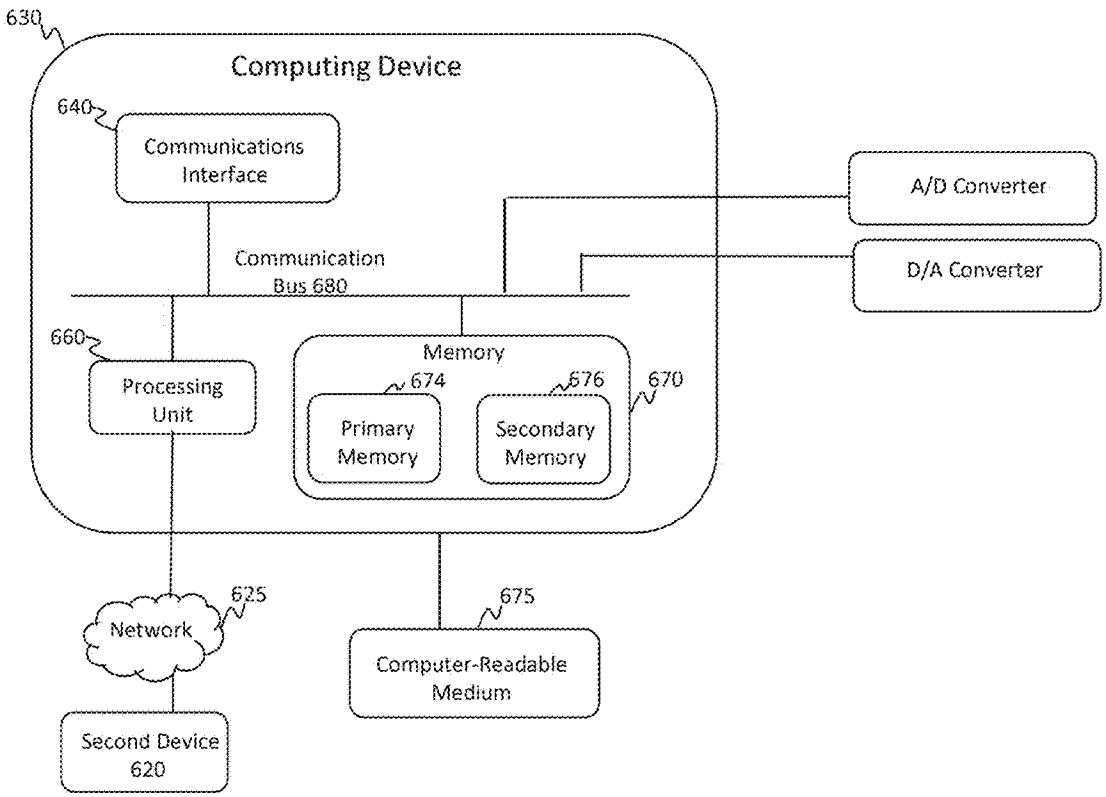
FIG. 6 is a schematic diagram illustrating an embodiment of a computing device.

For purposes of illustration, FIG. 6 is an illustration of an embodiment 600 of a system that may be employed in a client-server type interaction, such as described infra., in connection with rendering a GUI via a device, for example, such as a smart phone or similar mobile device, which may, for example, include a computing device 630. Thus, computing device 630 may include a capability to execute instructions, such as may be stored in a memory, such as 670. Stored instructions may be executable, such as by computing device 630, as previously suggested, to perform various types of signal processing. It is likewise noted that in a smart phone embodiment, for example, computing device 630 may provide digital signals to a D/A converter and/or may receive digital signals from an A/D converter, as shown. In addition, computing device 630 may include a communications interface 640, a processor (e.g., processing unit) 660, a memory 670, which may comprise primary memory 674 and secondary memory 676, and may communicate by way of a communication bus 680, for example.

In an embodiment, the computing device 630 may be coupled or connected to a computer-readable medium 675. In FIG. 6, the computing device may represent one or more sources of analog, uncompressed digital, lossless compressed digital, and/or lossy compressed digital formats for content of various types, such as video, imaging, text, audio, etc. in the form physical states and/or signals, for example. Computing device 630 may communicate with other computing devices by way of a connection, such as an internet connection, via network 625, for example. Although the computing device of FIG. 6 shows the above-identified components, claimed subject matter is not limited to computing devices having only these components as other implementations may include alternative arrangements that may comprise additional components or fewer components, such as components that function differently while achieving similar results. Rather, examples are provided merely as illustrations. It is not intended that claimed subject matter to limited in scope to illustrative examples.

Nonetheless, continuing, processor (processing unit) 660 may be representative of one or more circuits, such as digital circuits, to perform at least a portion of a computing procedure and/or process. By way of example, but not limitation, processor 660 may comprise one or more processors, such as controllers, microprocessors, microcontrollers, application specific integrated circuits, digital signal processors, programmable logic devices, field programmable gate arrays, the like, or any combination thereof. In implementations, processor 660 may perform signal processing to manipulate signals and/or states, to construct signals and/or states, etc., for example, as was mentioned.

Under direction of processor 660, memory 670, such as memory cells storing physical states, representing, for example, a program, may be executed by processor 660 and generated signals may be transmitted via the Internet, for example. Processor 660 may also receive digitally-encoded signals from another computing device, such as 620.

Memory 670 may be representative of any storage mechanism. Memory 670 may comprise, for example, primary memory 674 and secondary memory 676, additional memory circuits, mechanisms, or combinations thereof may be used. Memory 670 may comprise, for example, random access memory, read only memory, etc., such as in the form of one or more storage devices and/or systems, such as, for example, a disk drive, an optical disc drive, a tape drive, a solid-state memory drive, etc., just to name a few examples. Memory 670 may be utilized to store a program. Memory 670 may also comprise a memory controller for accessing computer readable-medium 675 that may carry and/or make accessible content, which may include code, and/or instructions, for example, executable by processor 660 and/or some other unit, such as a controller and/or processor, capable of executing instructions, for example.

Network 625 may comprise one or more network communication links, processes, services, applications and/or resources to support exchanging communication signals between a client computing device, such as 630, and second computing device 620 ('second device' in figure), which may, for example, comprise one or more servers (not shown). By way of example, but not limitation, network 625 may comprise wireless and/or wired communication links, telephone and/or telecommunications systems, Wi-Fi networks, Wi-MAX networks, the Internet, a local area network (LAN), a wide area network (WAN), or any combinations thereof.

The term "computing device," as used herein, refers to a system and/or a device, such as a computing apparatus, that includes a capability to process (e.g., perform computations) and/or store content, such as measurements, text, images, video, audio, etc. in the form of signals and/or states. Thus, a computing device, in this context, may comprise hardware, software, firmware, or any combination thereof (other than software per se). Computing device 630, as depicted in FIG. 6, is merely one example, and claimed subject matter is not limited in scope to this particular example. For one or more embodiments, a computing device may comprise any of a wide range of digital electronic devices, including, but not limited to, personal desktop and/or notebook computers, high-definition televisions, digital versatile disc (DVD) players and/or recorders, game consoles, satellite television receivers, cellular telephones, wearable devices, personal digital assistants, mobile audio and/or video playback and/or recording devices, or any combination of the above. Further, unless specifically stated otherwise, a process as described herein, with reference to flow diagrams and/or otherwise, may also be executed and/or affected, in whole or in part, by a computing platform Memory 670 may store cookies relating to one or more users and may also comprise a computer-readable medium that may carry and/or make accessible content, including code and/or instructions, for example, executable by processor 660 and/or some other unit, such as a controller and/or processor, capable of executing instructions, for example. A user may make use of an input device, such as a computer mouse, stylus, track ball, keyboard, and/or any other similar device capable of receiving user actions and/or motions as input signals. Likewise, a user may make use of an output device, such as a display, a printer, etc., and/or any other device capable of providing signals and/or generating stimuli for a user, such as visual stimuli, audio stimuli and/or other similar stimuli.

Regarding aspects related to a communications and/or computing network, a wireless network may couple client devices with a network. A wireless network may employ stand-alone ad-hoc networks, mesh networks, Wireless LAN (WLAN) networks, cellular networks, and/or the like. A wireless network may further include a system of terminals, gateways, routers, and/or the like coupled by wireless radio links, and/or the like, which may move freely, randomly and/or organize themselves arbitrarily, such that network topology may change, at times even rapidly. A wireless network may further employ a plurality of network access technologies, including Long Term Evolution (LTE), WLAN, Wireless Router (WR) mesh, 2nd, 3rd, or 4th generation (2G, 3G, or 4G) cellular technology and/or the like. Network access technologies may enable wide area coverage for devices, such as client devices with varying degrees of mobility, for example.

A network may enable radio frequency and/or other wireless type communications via a wireless network access technology and/or air interface, such as Global System for Mobile communication (GSM), Universal Mobile Telecommunications System (UMTS), General Packet Radio Services (GPRS), Enhanced Data GSM Environment (EDGE), 3GPP Long Term Evolution (LTE), LTE Advanced, Wideband Code Division Multiple Access (WCDMA), Bluetooth, ultra wideband (UWB), 802.11b/g/n, and/or the like. A wireless network may include virtually any type of now known and/or to be developed wireless communication mechanism by which signals may be communicated between devices, between networks, within a network, and/or the like.

Communications between a computing device and/or a network device and a wireless network may be in accordance with known and/or to be developed communication network protocols including, for example, global system for mobile communications (GSM), enhanced data rate for GSM evolution (EDGE), 802.11b/g/n, and/or worldwide interoperability for microwave access (WiMAX). A computing device and/or a networking device may also have a subscriber identity module (SIM) card, which, for example, may comprise a detachable or embedded smart card that is able to store subscription content of a user, and/or is also able to store a contact list of the user. A user may own the computing device and/or networking device or may otherwise be a user, such as a primary user, for example. A computing device may be assigned an address by a wireless network operator, a wired network operator, and/or an Internet Service Provider (ISP). For example, an address may comprise a domestic or international telephone number, an Internet Protocol (IP) address, and/or one or more other identifiers. In other embodiments, a computing and/or communications network may be embodied as a wired network, wireless network, or any combinations thereof.

A device, such as a computing and/or networking device, may vary in terms of capabilities and/or features. Claimed subject matter is intended to cover a wide range of potential variations. For example, a device may include a numeric keypad and/or other display of limited functionality, such as a monochrome liquid crystal display (LCD) for displaying text, for example. In contrast, however, as another example, a web-enabled device may include a physical and/or a virtual keyboard, mass storage, one or more accelerometers, one or more gyroscopes, global positioning system (GPS) and/or other location-identifying type capability, and/or a display with a higher degree of functionality, such as a touch-sensitive color 2D or 3D display, for example.

A computing and/or network device may include and/or may execute a variety of now known and/or to be developed operating systems, derivatives and/or versions thereof, including personal computer operating systems, such as a Windows, iOS, Linux, a mobile operating system, such as iOS, Android, Windows Mobile, and/or the like. A computing device and/or network device may include and/or may execute a variety of possible applications, such as a client software application enabling communication with other devices, such as communicating one or more messages, such as via protocols suitable for transmission of email, short message service (SMS), and/or multimedia message service (MMS), including via a network, such as a social network including, but not limited to, Facebook, LinkedIn, Twitter, Flickr, and/or Google+, to provide only a few examples. A computing and/or network device may also include and/or execute a software application to communicate content, such as, for example, textual content, multimedia content, and/or the like. A computing and/or network device may also include and/or execute a software application to perform a variety of possible tasks, such as browsing, searching, playing various forms of content, including locally stored and/or streamed video, and/or games such as, but not limited to, fantasy sports leagues. The foregoing is provided merely to illustrate that claimed subject matter is intended to include a wide range of possible features and/or capabilities.

A network may also be extended to another device communicating as part of another network, such as via a virtual private network (VPN). To support a VPN, broadcast domain signal transmissions may be forwarded to the VPN device via another network. For example, a software tunnel may be created between a logical broadcast domain, and a VPN device. Tunneled traffic may, or may not be encrypted, and a tunneling protocol may be substantially compliant with and/or substantially compatible with any now known and/or to be developed versions of any of the following protocols: IPSec, Transport Layer Security, Datagram Transport Layer Security, Microsoft Point-to-Point Encryption, Microsoft's Secure Socket Tunneling Protocol, Multipath Virtual Private Network, Secure Shell VPN, another existing protocol, and/or another protocol that may be developed.

A network may communicate via signal packets and/or frames, such as in a network of participating digital communications. A broadcast domain may be substantially compliant and/or substantially compatible with, but is not limited to, now known and/or to be developed versions of any of the following network protocol stacks: ARCNET, AppleTalk, ATM, Bluetooth, DECnet, Ethernet, FDDI, Frame Relay, HIPPI, IEEE 1394, IEEE 802.11, IEEE-488, Internet Protocol Suite, IPX, Myrinet, OSI Protocol Suite, QsNet, RS-232, SPX, System Network Architecture, Token Ring, USB, and/or X.25. A broadcast domain may employ, for example, TCP/IP, UDP, DECnet, NetBEUI, IPX, Appletalk, other, and/or the like. Versions of the Internet Protocol (IP) may include IPv4, IPv6, other, and/or the like.

Algorithmic descriptions and/or symbolic representations are examples of techniques used by those of ordinary skill in the signal processing and/or related arts to convey the substance of their work to others skilled in the art. An algorithm is here, and generally, is considered to be a self-consistent sequence of operations and/or similar signal processing leading to a desired result. In this context, operations and/or processing involves physical manipulation of physical quantities. Typically, although not necessarily, such quantities may take the form of electrical and/or magnetic signals and/or states capable of being stored, transferred, combined, compared, processed or otherwise manipulated as electronic signals and/or states representing various forms of content, such as signal measurements, text, images, video, audio, etc. It has proven convenient at times, principally for reasons of common usage, to refer to such physical signals and/or physical states as bits, values, elements, symbols, characters, terms, numbers, numerals, measurements, content and/or the like. It should be understood, however, that all of these and/or similar terms are to be associated with appropriate physical quantities and are merely convenient labels. Unless specifically stated otherwise, as apparent from the preceding discussion, it is appreciated that throughout this specification discussions utilizing terms such as "processing," "computing," "calculating," "determining", "establishing", "obtaining", "identifying", "selecting", "generating", and/or the like may refer to actions and/or processes of a specific apparatus, such as a special purpose computer and/or a similar special purpose computing and/or network device. In the context of this specification, therefore, a special purpose computer and/or a similar special purpose computing and/or network device is capable of processing, manipulating and/or transforming signals and/or states, typically represented as physical electronic and/or magnetic quantities within memories, registers, and/or other storage devices, transmission devices, and/or display devices of the special purpose computer and/or similar special purpose computing and/or network device. In the context of this particular patent application, as mentioned, the term "specific apparatus" may include a general purpose computing and/or network device, such as a general purpose computer, once it is programmed to perform particular functions pursuant to instructions from program software.

In some circumstances, operation of a memory device, such as a change in state from a binary one to a binary zero or vice-versa, for example, may comprise a transformation, such as a physical transformation. With particular types of memory devices, such a physical transformation may comprise a physical transformation of an article to a different state or thing. For example, but without limitation, for some types of memory devices, a change in state may involve an accumulation and/or storage of charge or a release of stored charge. Likewise, in other memory devices, a change of state may comprise a physical change, such as a transformation in magnetic orientation and/or a physical change and/or transformation in molecular structure, such as from crystalline to amorphous or vice-versa. In still other memory devices, a change in physical state may involve quantum mechanical phenomena, such as, superposition, entanglement, and/or the like, which may involve quantum bits (qubits), for example. The foregoing is not intended to be an exhaustive list of all examples in which a change in state form a binary one to a binary zero or vice-versa in a memory device may comprise a transformation, such as a physical transformation. Rather, the foregoing is intended as illustrative examples.

In the preceding description, various aspects of claimed subject matter have been described. For purposes of explanation, specifics, such as amounts, systems and/or configurations, as examples, were set forth. In other instances, well-known features were omitted and/or simplified so as not to obscure claimed subject matter. While certain features have been illustrated and/or described herein, many modifications, substitutions, changes and/or equivalents will now occur to those skilled in the art. It is, therefore, to be understood that the appended claims are intended to cover all modifications and/or changes as fall within claimed subject matter.

The invention claimed is:

1. An apparatus comprising:

an adapter including a telecoil, the adapter including an audio plug for audio signals received wirelessly via the telecoil to be communicated to and from the adapter via an electrical connection to an external device, and the adapter further including at least one of the following: an audio jack to physically receive an external audio plug in which the audio jack of the adapter is to receive the audio signals from the audio plug of the adapter via the electrical connection to the external device and/or headphones physically part of the adapter and electrically connected to receive the audio signals from the audio plug of the adapter, wherein the telecoil is incorporated into the adapter and the adapter is integrated into a cable electrically connected to the headphones at one end and including the audio plug at the other end; and a mobile device including a storage medium, wherein the mobile device further comprises at least one of the following: a smart phone, a tablet, a laptop, a personal digital assistant, or a wearable computing device, the storage medium having stored thereon instructions executable by a computing device to process the audio signals, the audio signals to comprise electrical signals, the electrical signals to be induced in the telecoil by an electromagnetic (EM) field, the EM field to be generated by an external hearing loop, the electrical signals to be induced to further be amplified, and the instructions further executable to generate a quality rating for a hearing loop system associated with the electrical signals, the quality rating to be based at least in part on the electrical signals.

2. The apparatus of claim 1, and further comprising: headphones external to the adapter including an audio plug external to the adapter in which the external audio plug is capable of being mated with the audio jack of the adapter in a manner resulting in an electrical connection to receive the audio signals from the audio plug of the adapter via the audio jack.

3. The apparatus of claim 1, wherein the telecoil comprises an active telecoil and/or a passive telecoil.

4. The apparatus of claim 1, wherein the adapter further comprises an amplifier to receive signals to be induced in the telecoil.

5. The apparatus of claim 1, wherein the instructions are further executable to filter the audio signals to improve signal-to-noise ratio.

6. The apparatus of claim 1, wherein the instructions are further executable to perform noise cancellation on the audio signals to improve signal-to-noise ratio.

7. The apparatus of claim 1, wherein the instructions are further executable to substantially equalize the audio signals.

8. The apparatus of claim 1, wherein the adapter further includes a switch in a circuit configuration so as to toggle between the telecoil and a component to bypass the telecoil, the switch responsive to signals to be received from the external device.

9. The apparatus of claim 8, wherein the component to bypass the telecoil comprises a microphone.

10. The apparatus of claim 1, wherein the adapter further includes a switch in a circuit configuration so as to toggle between the telecoil, a microphone, and a position to activate both the telecoil and microphone, the switch responsive to signals to be received from the external device.

* * * * *